US011295672B2

(12) United States Patent
Na

(10) Patent No.: US 11,295,672 B2
(45) Date of Patent: Apr. 5, 2022

(54) EMISSION DRIVER AND DISPLAY DEVICE HAVING THE SAME

(71) Applicant: Samsung Display Co., Ltd., Yongin-Si (KR)

(72) Inventor: Ji Su Na, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/994,016

(22) Filed: Aug. 14, 2020

(65) Prior Publication Data

US 2021/0193040 A1 Jun. 24, 2021

(30) Foreign Application Priority Data

Dec. 23, 2019 (KR) ..... 10-2019-0173289

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2300/0426* (2013.01); *G09G 2310/08* (2013.01)

(58) Field of Classification Search
CPC .. G09G 3/3233; G09G 3/3258; G09G 3/3266; G09G 3/3275; G09G 2300/0426; G09G 2300/0439; G09G 2310/08; G09G 2310/0286
USPC ..... 345/212
See application file for complete search history.

(56) References Cited

U.S. PATENT DOCUMENTS

| | | | | |
|---|---|---|---|---|
| 8,299,982 | B2 * | 10/2012 | Chung | G11C 19/28 345/76 |
| 8,610,645 | B2 * | 12/2013 | Koyama | G09G 3/30 345/76 |
| 9,881,689 | B2 * | 1/2018 | Lee | G09G 3/3266 |
| 10,255,851 | B2 * | 4/2019 | Jang | H03K 17/687 |
| 10,311,781 | B2 | 6/2019 | Lee et al. | |
| 10,453,386 | B2 | 10/2019 | Jang | |
| 10,497,317 | B2 * | 12/2019 | Lim | G09G 3/3266 |
| 10,679,549 | B2 * | 6/2020 | Yu | G09G 3/20 |
| 2006/0044230 | A1 * | 3/2006 | Eom | G09G 3/3233 345/76 |

(Continued)

FOREIGN PATENT DOCUMENTS

| | | | |
|---|---|---|---|
| KR | 10-2017-0133578 | A | 12/2017 |
| KR | 10-2017-0143052 | A | 12/2017 |
| KR | 10-2018-0125670 | A | 11/2018 |

*Primary Examiner* — Tom V Sheng
(74) *Attorney, Agent, or Firm* — Innovation Counsel LLP

(57) ABSTRACT

An emission driver includes stages outputting an emission control signal. At least one of the stages includes an input circuit controlling voltages of a first node and a second node, an output circuit supplying a voltage of first power or a voltage of second power to an output terminal as the emission control signal in response to a voltage of a third node and a voltage of a fourth node, a first signal processor controlling the voltage of the fourth node, a second signal processor controlling the voltage of the fourth node, and a third signal processor controlling the voltage of the third node electrically connected to the first node in response to signals supplied to the second input terminal and the third input terminal and the voltage of the first node.

20 Claims, 10 Drawing Sheets

(56) References Cited

U.S. PATENT DOCUMENTS

| | | | | |
|---|---|---|---|---|
| 2012/0038609 | A1* | 2/2012 | Chung | G09G 3/3266 345/211 |
| 2012/0081409 | A1* | 4/2012 | Chung | G09G 3/3677 345/690 |
| 2013/0328495 | A1* | 12/2013 | Woo | G09G 3/3266 315/224 |
| 2014/0111092 | A1* | 4/2014 | Kim | G09G 3/3266 315/127 |
| 2016/0210892 | A1* | 7/2016 | Ohara | G09G 3/3266 |
| 2017/0263188 | A1* | 9/2017 | Na | G09G 3/3258 |
| 2017/0301295 | A1* | 10/2017 | Park | G09G 3/3258 |
| 2018/0330673 | A1 | 11/2018 | Kang et al. | |
| 2019/0012948 | A1* | 1/2019 | Ohara | G09G 3/3233 |
| 2019/0304375 | A1* | 10/2019 | Kim | G09G 3/3258 |
| 2019/0318690 | A1 | 10/2019 | Lee et al. | |
| 2019/0325845 | A1* | 10/2019 | Zhu | G09G 5/10 |
| 2020/0152127 | A1* | 5/2020 | Kang | G09G 3/3266 |
| 2020/0234638 | A1 | 7/2020 | Lee et al. | |
| 2020/0302870 | A1* | 9/2020 | Jang | G09G 3/3258 |
| 2020/0394952 | A1* | 12/2020 | Na | G09G 3/32 |
| 2021/0005144 | A1* | 1/2021 | Long | G09G 3/3233 |

* cited by examiner

EMISSION DRIVER AND DISPLAY DEVICE HAVING THE SAME

CROSS-REFERENCE TO RELATED APPLICATION

This application claims priority to Korean Patent Application No. 10-2019-0173289, filed on Dec. 23, 2019, and all the benefits accruing therefrom under 35 U.S.C. § 119, the content of which in its entirety is herein incorporated by reference.

BACKGROUND

1. Field

The present disclosure relates to a display device, and more particularly, to a display device including an emission driver.

2. Description of the Related Art

A display device includes a data driver for supplying a data signal to data lines, a scan driver for supplying a scan signal to scan lines, an emission driver for supplying an emission control signal to an emission control line, and pixels positioned to be connected to the data lines, the scan lines, and the emission control lines.

In a display device that has been recently studied, in order to increase resolution, implement a stereoscopic image (for example, high frequency driving or high speed driving), and reduce power consumption when displaying a still image (for example, low frequency driving, or low speed driving), development of a scan driver and an emission driver corresponding to various driving frequencies is required.

In particular, during high frequency driving, a falling time during which the scan signal and/or the emission control signal are/is transited from a logic high level to a logic low level may directly affect image quality of the pixel.

SUMMARY

The present disclosure provides an emission driver including a third signal processor that controls a falling step of an output signal and provides a display device including the emission layer.

However, the object of the disclosure is not limited to the above-described objects, and may be variously expanded within a range without departing from the spirit and scope of the disclosure.

In order to achieve an object of the disclosure, an emission driver according to embodiments of the disclosure may include a plurality of stages configured to output an emission control signal, and at least one of the stages may include an input circuit configured to control voltages of a first node and a second node in response to signals supplied to a first input terminal and a second input terminal, an output circuit configured to supply a voltage of first power or a voltage of second power to an output terminal as the emission control signal in response to a voltage of a third node and a voltage of a fourth node, a first signal processor connected to a fifth node electrically connecting the second node and the fourth node together and configured to control the voltage of the fourth node based on a signal supplied to a third input terminal and a voltage of the fifth node, a second signal processor configured to control the voltage of the fourth node based on the voltage of the first node, and a third signal processor configured to control the voltage of the third node electrically connected to the first node in response to the signals supplied to the second input terminal and the third input terminal and the voltage of the first node.

In an embodiment, the third signal processor may control a voltage change of the third node based on the voltage of the second power or a voltage of the emission control signal.

In an embodiment, the third signal processor may include a first transistor connected between the second power and a sixth node, and having a gate electrode connected to the third input terminal, a second transistor and a third transistor connected to the second transistor in series, and connected to the sixth node and the output terminal respectively, and a first capacitor connected between the sixth node and the third node, a gate electrode of the second transistor may be connected to the first node, and a gate electrode of the third transistor may be connected to the second input terminal.

In an embodiment, a voltage of the sixth node may be determined in correspondence with the voltage of the second power or a voltage of the output terminal.

In an embodiment, the third signal processor may control the voltage of the third node by using coupling of the first capacitor according to a voltage change of the sixth node.

In an embodiment, the emission control signal may be transited to a low level in synchronization with a voltage drop of the third node and a voltage drop of the sixth node.

In an embodiment, the input circuit may include a fourth transistor connected between the first input terminal and the first node, and having a gate electrode connected to the second input terminal, a fifth transistor connected between the second input terminal and the second node, and having a gate electrode connected to the first node, and a sixth transistor connected between the first power and the second node, and having a gate electrode connected to the second input terminal.

In an embodiment, the fifth transistor may include at least two sub transistors connected in series with each other, and each of the sub transistors may include a gate electrode commonly connected to the first node.

In an embodiment, the output circuit may include a seventh transistor connected between the first power and the output terminal, and having a gate electrode connected to the third node, and an eighth transistor connected between the second power and the output terminal, and having a gate electrode connected to the fourth node.

In an embodiment, each of the stages may further include a stabilizer electrically connected between the input circuit and the output circuit, and configured to limit a voltage drop of the first node and the second node.

In an embodiment, the stabilizer may include a twelfth transistor connected between the second node and the fifth node, and having a gate electrode connected to the first power and receiving the voltage of the first power, and a thirteenth transistor connected between the first node and the third node, and having a gate connected to the first power and electrode receiving the voltage of the first power.

In an embodiment, the first signal processor may include a second capacitor having a first terminal connected to the fifth node, a ninth transistor connected between a second terminal of the second capacitor and the fourth node, and having a gate electrode connected to the third input terminal, and a tenth transistor connected between the second terminal of the second capacitor and the third input terminal, and having a gate electrode connected to the fifth node.

In an embodiment, the second signal processor may include an eleventh transistor connected between the second power and the fourth node, and having a gate electrode electrically connected to the first node, and a third capacitor connected between the second power and the fourth node.

In an embodiment, the second signal processor may include an eleventh transistor connected between the first power and the fourth node, and having a gate electrode electrically connected to the third node, and a third capacitor connected between the first power and the fourth node.

In an embodiment, the first input terminal may receive an output signal of a previous stage or a start pulse.

In an embodiment, the second input terminal may receive a first clock signal, and the third input terminal may receive a second clock signal obtained by shifting the first clock signal.

In order to achieve an object of the disclosure, a display device according to embodiments of the disclosure may include a plurality of pixels, a scan driver configured to supply a scan signal to the pixels through scan lines, a data driver configured to supply a data signal to the pixels through data lines, and an emission driver including a plurality of stages to supply an emission control signal to the pixels through emission control lines, and each of the stages may include an input circuit configured to control voltages of a first node and a second node in response to signals supplied to a first input terminal and a second input terminal, an output circuit configured to supply a voltage of first power or a voltage of second power to an output terminal as the emission control signal in response to a voltage of a third node and a voltage of a fourth node, a first signal processor connected to a fifth node electrically connecting the second node and the fourth node to each other and configured to control the voltage of the fourth node based on the signal supplied to a third input terminal and a voltage of the fifth node, a second signal processor configured to control the voltage of the fourth node based on the voltage of the third node, and a third signal processor configured to control the voltage of the third node electrically connected to the first node in response to the signals supplied to the second input terminal and the third input terminal and the voltage of the first node.

In an embodiment, each of the pixels may include an N-type transistor including an oxide semiconductor.

In an embodiment, the scan driver may include a scan stage that outputs an N-type scan signal for controlling the N-type transistor, and the scan stage may have the same configuration as the stage.

In an embodiment, the third signal processor may control a voltage change of the third node based on the voltage of the first power or a voltage of the emission control signal.

In an embodiment, the third signal processor may include a first transistor connected between the second power and a sixth node, and having a gate electrode connected to the third input terminal, a second transistor and a third transistor connected to the second transistor in series, and connected to the sixth node and the output terminal respectively, and a first capacitor connected between the sixth node and the third node, a gate electrode of the second transistor may be connected to the first node, and a gate electrode of the third transistor may be connected to the second input terminal.

BRIEF DESCRIPTION OF THE DRAWINGS

The above and other features of the disclosure will become more apparent by describing in further detail embodiments thereof with reference to the accompanying drawings, in which.

DETAILED DESCRIPTION OF THE EMBODIMENT

Figure 1:
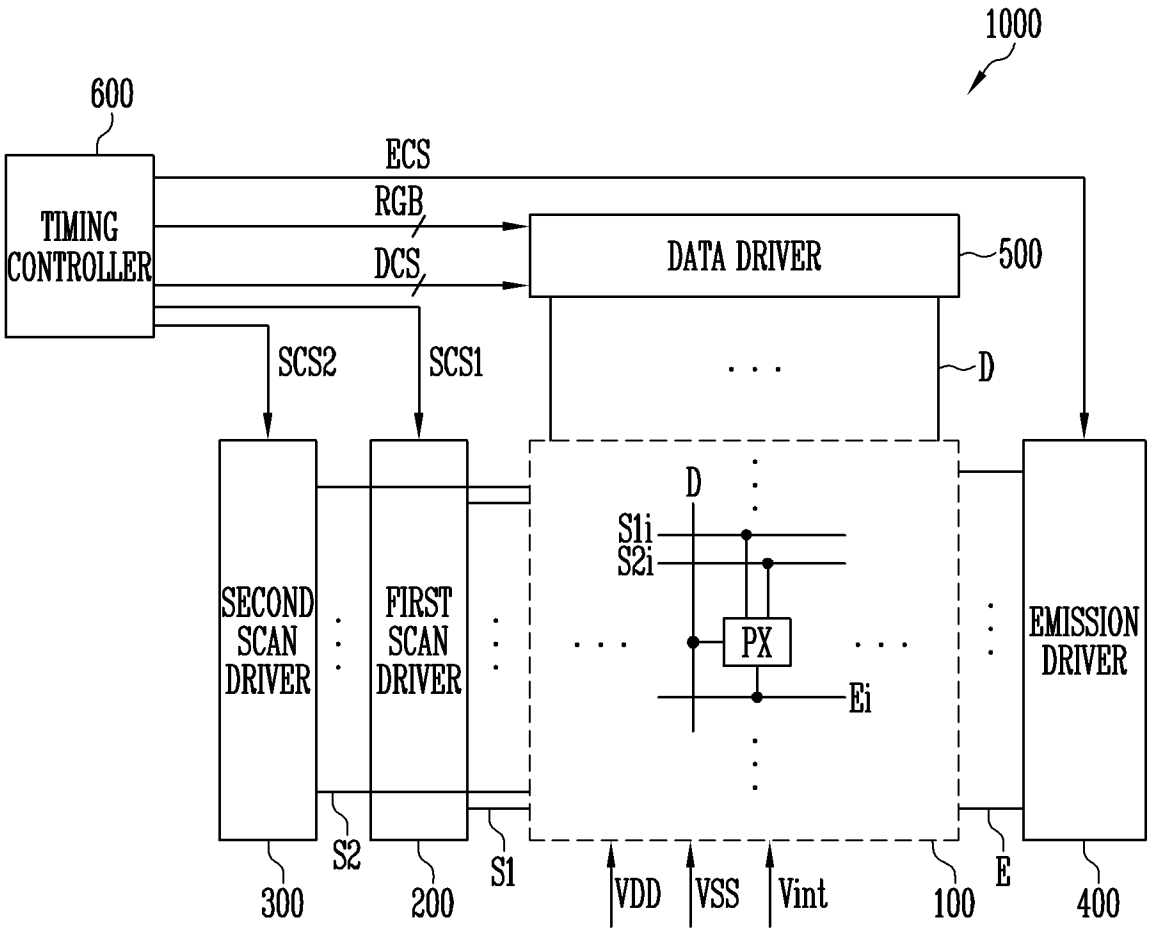
FIG. 1 is a block diagram illustrating a display device according to embodiments of the disclosure.

Hereinafter, a preferable embodiment of the disclosure will be described in detail with reference to the accompanying drawings. The same reference numerals are used for the same components in the drawings, and repetitive description of the same components is omitted.

FIG. 1 is a block diagram illustrating a display device according to embodiments of the disclosure.

Referring to FIG. 1, the display device 1000 may include a display unit 100, a first scan driver 200 (or a first gate driver), a second scan driver 300 (or a second gate driver), an emission driver 400 (or a third gate driver), a data driver 500, and a timing controller 600.

The display device 1000 may display an image at various driving frequencies (or image refresh rate or screen refresh rate) according to a driving condition. The driving frequency is a frequency at which a data signal is substantially written to a driving transistor of a pixel PX. For example, the driving frequency is also referred to as a screen scan rate and a screen refresh rate, and represents a frequency at which a display screen is reproduced for one second. The display device 1000 may display an image in correspondence with various driving frequencies of 1 Hz to 120 Hz.

The display unit 100 displays the image. The display unit 100 includes the pixels PX positioned to be connected to data lines D, scan lines S1 and S2, and emission control lines E. The pixels PXs may receive voltages of first driving power VDD, second driving power VSS, and initialization power Vint from an external source (not shown).

Each of the pixels PX is selected when a scan signal is supplied to the scan lines S1 and S2 connected to the pixel PX to receive a data signal from the data line D. The pixel PX controls an amount of current flowing from the first driving power VDD to the second driving power VSS via a light emitting element, in correspondence with the data signal. The light emitting element generates light of a predetermined luminance in correspondence with the amount of current. An emission time of each of the pixels PX is controlled by an emission control signal supplied from the emission control line E connected to the pixel.

In addition, the pixels PX may be connected to one or more first scan lines S1, second scan lines S2, and emission control lines E in correspondence with a pixel circuit structure.

The timing controller 600 may receive an input control signal and/or an input image signal from an image source such as an external graphic device. The timing controller 600 generates image data RGB corresponding to an operation condition of the display unit 100 based on the input image signal and provides the image data RGB to the data driver 500. The timing controller 600 may generate a first driving control signal SCS1 for controlling a driving timing of the first scan driver 200, a second driving control signal SCS2 for controlling a driving timing of the second scan driver 300, a third driving control signal ECS for controlling a driving timing of the emission driver 400, a fourth driving control signal DCS for controlling a driving timing of the data driver 500, based on the input control signal, and may provide the first driving control signal SCS1, the second driving control signal SCS2, the third driving control signal ECS, and the fourth driving control signal DCS to the first scan driver 200, the second scan driver 300, the emission driver 400, and the data driver 500, respectively.

The first driving control signal SCS1 may include a first scan start pulse and clock signals. The first scan start pulse may control a first timing of a first scan signal. The clock signals are used to shift the first scan start pulse.

The second driving control signal SCS2 may include a second scan start pulse and clock signals. The second scan start pulse may control a first timing of a second scan signal. The clock signals are used to shift the second scan start pulse.

The third driving control signal ECS may include an emission control start pulse and clock signals. The emission control start pulse may control a first timing of the emission control signal. The clock signals are used to shift the emission control start pulse.

The fourth driving control signal DCS may include a source start pulse and clock signals. The source start pulse may control a sampling start time of data. The clock signals are used to control a sampling operation.

The first scan driver 200 may receive the first driving control signal SCS1 from the timing controller 600. The first scan driver 200 may supply the scan signal to the first scan lines S1 in response to the first driving control signal SCS1.

The second scan driver 300 may receive the second driving control signal SCS2 from the timing controller 600. The second scan driver 300 may supply the scan signal to the second scan lines S2 in response to the second driving control signal SCS2.

The emission driver 400 may receive the third driving control signal ECS from the timing controller 600. The emission driver 400 may supply the emission control signal to the emission control lines E in response to the third driving control signal ECS.

The data driver 500 may receive the fourth driving control signal DCS from the timing controller 600. The data driver 500 may supply the data signal (data voltage) of an analog format to the data lines D in response to the fourth driving control signal DCS.

Figure 2:
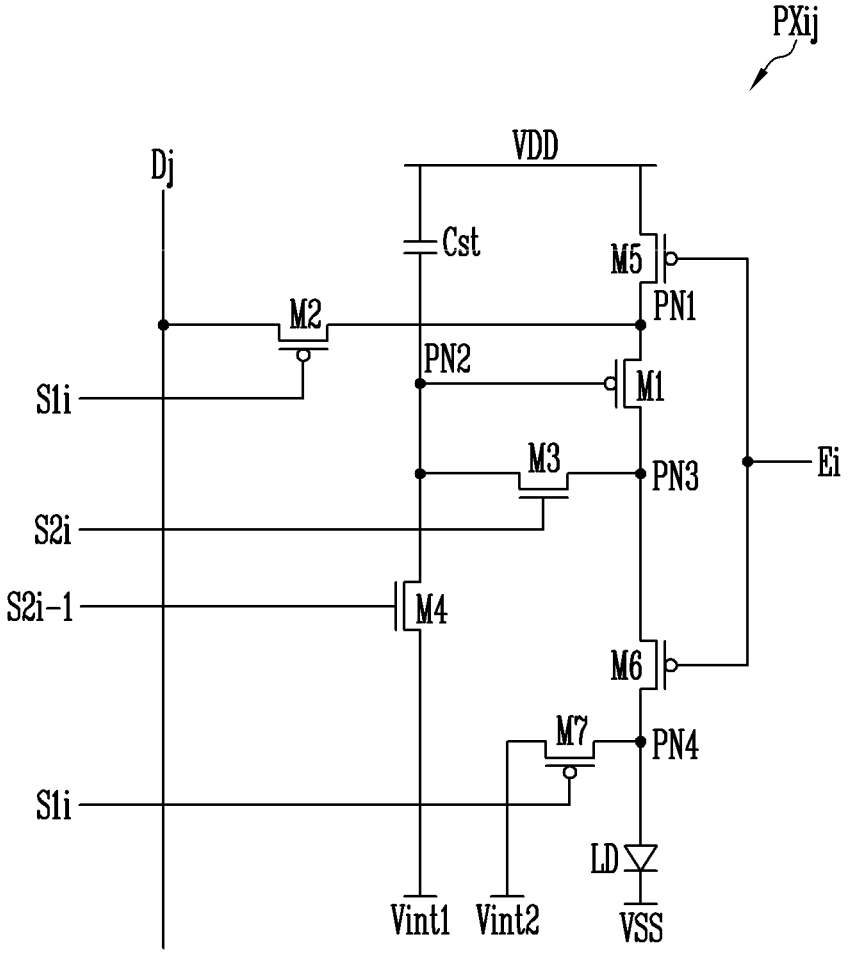
FIG. 2 is a circuit diagram illustrating an example of a pixel included in the display device of FIG. 1.

FIG. 2 is a circuit diagram illustrating an example of the pixel included in the display device of FIG. 1.

In FIG. 2, for convenience of description, a pixel PXij positioned in an i-th horizontal line (or an i-th pixel row) and connected to a j-th data line Dj will be shown (where, i and j are natural numbers).

Referring to FIG. 2, the pixel PXij may include a light emitting element LD, first, second, third, fourth, fifth, sixth, and seventh transistors M1, M2, M3, M4, M5, M6, and M7, and a storage capacitor Cst.

A first electrode (anode electrode or cathode electrode) of the light emitting element LD is connected to a fourth node PN4, and a second electrode (cathode electrode or anode electrode) is connected to the second driving power VSS. The light emitting element LD generates light of a predetermined luminancne in correspondence with an amount of current supplied from the first transistor M1.

In an embodiment, the light emitting element LD may be an organic light emitting diode including an organic light emitting layer. In another embodiment, the light emitting element LD may be an inorganic light emitting element formed of an inorganic material. Alternatively, the light emitting element LD may have a form in which a plurality of inorganic light emitting elements are connected in parallel and/or in series between the second driving power VSS and the fourth node PN4.

A first electrode of the first transistor M1 (or a driving transistor) is connected to a first node PN1, and a second electrode is connected to a third node PN3. A gate electrode of the first transistor M1 is connected to a second node PN2. The first transistor M1 may control the amount of current flowing from the first driving power VDD to the second driving power VSS via the light emitting element LD in correspondence with a voltage of the second node PN2. To this end, the first driving power VDD may be set to a voltage higher than that of the second driving power VSS.

The second transistor M2 is connected between the data line Dj and the first node PN1. A gate electrode of the second transistor M2 is connected to an i-th first scan line S1*i*. The second transistor M2 is turned on when the first scan signal is supplied to the i-th first scan line S1*i*, to electrically connect the data line Dj and the first node PN1 to each other.

The third transistor M3 is connected between the second electrode of the first transistor M1 (that is, the third node PN3) and the second node PN2. A gate electrode of the third transistor M3 is connected to an i-th second scan line S2*i*. The third transistor M3 is turned on when the second scan signal is supplied to the i-th second scan line S2*i*, to electrically connect the second electrode of the first transistor M1 and the second node PN2 to each other. Therefore, when the third transistor M3 is turned on, the first transistor M1 is connected in a diode form.

The fourth transistor M4 is connected between the second node PN2 and a first initialization power Vint1. A gate electrode of the fourth transistor M4 is connected to an (i−1)-th second scan line S2*i*−1. The fourth transistor M4 is turned on when the second scan signal is supplied to the (i−1)-th second scan line S2*i*−1, to supply a voltage of the first initialization power Vint1 to the second node PN2. Here, the voltage of the first initialization power Vint1 is set to a voltage lower than that of the data signal supplied to the data line Dj.

Therefore, a gate voltage of the first transistor M1 may be initialized to the voltage of the first initialization power Vint1 by turn-on of the fourth transistor M4, and the first transistor M1 may have an on-bias state (that is, the first transistor M1 is initialized to the on-bias state).

The fifth transistor M5 is connected between the first driving power VDD and the first node PN1. A gate electrode of the fifth transistor M5 is connected to an i-th emission control line Ei. The fifth transistor M5 is turned off when the emission control signal is supplied to the i-th emission control line Ei, and is turned on in other cases.

The sixth transistor M6 is connected between the second electrode of the first transistor M1 (that is, the third node PN3) and the first electrode of the light emitting element LD (that is, the fourth node PN4). A gate electrode of the sixth transistor M6 is connected to the i-th emission control line Ei. The sixth transistor M6 is turned off when the emission control signal is supplied to the i-th emission control line Ei, and is turned on in other cases.

The seventh transistor M7 is connected between the first electrode of the light emitting element LD (that is, the fourth node PN4) and a second initialization power Vint2. A gate electrode of the seventh transistor M7 is connected to the i-th first scan line S1*i*. The seventh transistor M7 is turned on when the first scan signal is supplied to the i-th first scan line S1*i*, to supply a voltage of the second initialization power Vint2 to the first electrode of the light emitting element LD.

However, this is an example, the gate electrode of the seventh transistor M7 may be connected to an (i−1)-th first scan line S1*i*−1 (not shown) or an (i+1)-th first scan line Sli+1 (not shown).

When the voltage of the second initialization power Vint2 is supplied to the first electrode of the light emitting element LD, a parasitic capacitor of the light emitting element LD may be discharged. As a residual voltage charged in the parasitic capacitor is discharged (removed), unintended micro emission may be prevented. Therefore, a black expression capability of the pixel PXij may be improved.

Meanwhile, the first initialization power Vint1 and the second initialization power Vint2 may generate different voltages. That is, the voltage for initializing the second node PN2 and the voltage for initializing the fourth node PN4 may be set differently.

For example, in a display device of a low frequency driving, the voltage of the first initialization power Vint1 higher than the voltage of the second driving power VSS may be required.

However, when the voltage of the second initialization power Vint2 supplied to the fourth node PN4 becomes higher than a predetermined reference, the voltage of the parasitic capacitor of the light emitting element LD may be charged rather than discharged. Therefore, the voltage of the second initialization power Vint2 may be set to a voltage lower than the voltage of the second driving power VSS.

The storage capacitor Cst is connected between the first driving power VDD and the second node PN2. The storage capacitor Cst may store the voltage applied to the second node PN2.

Meanwhile, the first transistor M1, the second transistor M2, the fifth transistor M5, the sixth transistor M6, and the seventh transistor M7 may be formed of a polysilicon semiconductor transistor. For example, the first transistor M1, the second transistor M2, the fifth transistor M5, the sixth transistor M6, and the seventh transistor M7 may include a polysilicon semiconductor layer formed through a low temperature poly-silicon (LTPS) process as an active layer (channel). In addition, the first transistor M1, the second transistor M2, the fifth transistor M5, the sixth transistor M6, and the seventh transistor M7 may be P-type transistors. Therefore, a gate-on voltage for turning on the first transistor M1, the second transistor M2, the fifth transistor M5, the sixth transistor M6, and the seventh transistor M7 may be a logic low level.

Since the polysilicon semiconductor transistor has an advantage of fast response speed, the polysilicon semiconductor transistor may be applied to a switching element requiring fast switching.

The third and fourth transistors M3 and M4 may be formed of an oxide semiconductor transistor. For example, the third and fourth transistors M3 and M4 may be N-type oxide semiconductor transistors and may include an oxide semiconductor layer as an active layer. Therefore, the gate-on voltage for turning on the third and fourth transistors M3 and M4 may be a logic high level.

The oxide semiconductor transistor is capable of a low temperature process and has low charge mobility in comparison with the polysilicon semiconductor transistor. That is, the oxide semiconductor transistor is excellent in an off-current characteristic. Therefore, when the third transistor M3 and the fourth transistor M4 are formed of the oxide semiconductor transistor, a leakage current from the second node PN2 may be minimized, so that display quality can be improved.

Figure 3:
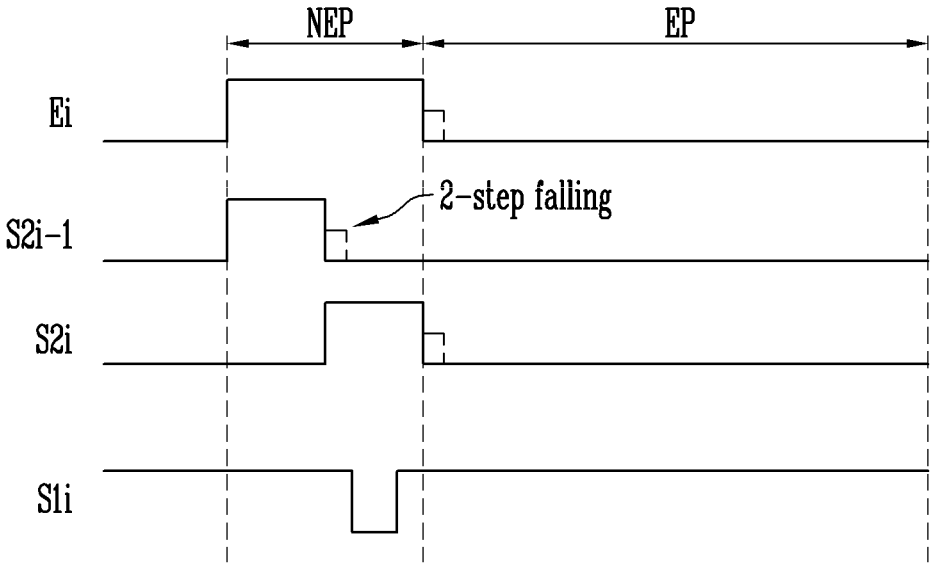
FIG. 3 is a timing diagram illustrating an example of driving of the pixel of FIG. 2.

FIG. 3 is a timing diagram illustrating an example of driving of the pixel of FIG. 2.

Referring to FIGS. 1, 2, and 3, the pixel PXij may receive signals for displaying an image in a non-emission period NEP and emit light based on the signals in an emission period EP.

A gate-on voltage of the second scan signal supplied to the i-th and (i−1)-th second scan lines S2*i* and S2*i*−1 connected to the third and fourth transistors M3 and M4 which are N-type transistors is a logic high level. A gate-on voltage of the first scan signal supplied to the i-th first scan line S1*i* connected to the first, second, and seventh transistors M1, M2, and M7 which are P-type transistors is a logic low level. A gate-on voltage of the emission control signal supplied to the i-th emission control line Ei connected to the fifth and sixth transistors M5 and M6 which are P-type transistors is a logic low level.

First, the emission control signal is supplied to the i-th emission control line Ei. When the emission control signal is supplied to the i-th emission control line Ei, the fifth and sixth transistors M5 and M6 are turned off. When the fifth and sixth transistors M5 and M6 are turned off, the pixel PXij is set to a non-emission state.

Thereafter, the second scan signal is supplied to the (i−1)-th second scan line S2*i*−1. When the second scan signal is supplied to the (i−1)-th second scan line S2*i*−1, the fourth transistor M4 is turned on. When the fourth transistor M4 is turned on, the voltage of the first initialization power Vint1 is supplied to the second node PN2.

Thereafter, the first and second scan signals are supplied to the i-th first scan line S1*i* and the i-th second scan line S2*i*, respectively. When the second scan signal is supplied to the i-th second scan line S2*i*, the third transistor M3 is turned on. When the third transistor M3 is turned on, the first transistor M1 is connected in the form of diode, and a threshold voltage of the first transistor M1 may be compensated.

When the first scan signal is supplied to the i-th first scan line S1*i*, the second transistor M2 is turned on. When the second transistor M2 is turned on, the data signal from the data line Dj is supplied to the first node PN1. At this time, since the second node PN2 is initialized to the voltage of the first initialization power Vint1 lower than the data signal (for example, initialized to the on-bias state), the first transistor M1 is turned on.

When the first transistor M1 is turned on, the data signal supplied to the first node PN1 is supplied to the second node PN2 via the first transistor M1 connected in the form of diode. Then, a voltage corresponding to the data signal and the threshold voltage of the first transistor M1 is applied to the second node PN2. At this time, the storage capacitor Cst stores the voltage of the second node PN2.

In addition, when the first scan signal is supplied to the i-th first scan line S1*i*, the seventh transistor M7 is turned on. When the seventh transistor M7 is turned on, the voltage of the second initialization power Vint2 is supplied to the first electrode of the light emitting element LD (that is, the fourth node PN4). Therefore, the residual voltage remaining in the parasitic capacitor of the light emitting element LD may be discharged.

Thereafter, the supply of the emission control signal to the i-th emission control line Ei is stopped. When the supply of the emission control signal to the i-th emission control line Ei is stopped, the fifth and sixth transistors M5 and M6 are turned on. At this time, the first transistor M1 controls the driving current flowing to the light emitting element LD in correspondence with the voltage of the second node PN2. Then, the light emitting element LD generates light of the luminance corresponding to the amount of current.

In an embodiment, a width of the second scan signal may be greater than a width of the first scan signal to ensure a sufficient threshold voltage compensation time in high speed driving of which a length of one horizontal period is short. On the other hand, according to a configuration of the conventional second scan driver 300 and the emission driver 400, a falling time in which an output signal is transited from a logic high level to a logic low level increases or falling of the output signal proceeds in a step form (for example, 2-step falling). That is, as the gate voltage of a pull-down transistor that is responsible for an output of the logic low level decreases in steps, the step is generated in the falling of the output signal and a falling speed decreases.

For example, when falling of the second scan signal is transited in a step form or a falling time increases, a turn-off operation of the third transistor M3 may become unstable. When the turn-off operation of the third transistor M3 is unstable, the threshold voltage compensation may proceed to an unwanted level, and thus image quality may be degraded.

Similarly, when falling of the emission control signal is transited in a step form or a falling time increases, a start of the emission period EP may become unstable and the image quality may be degraded.

The second scan driver 300 and/or the emission driver 400 according to embodiments of the disclosure may include a configuration for removing a step of falling of an output signal and controlling a falling speed to be increased.

Figure 4:
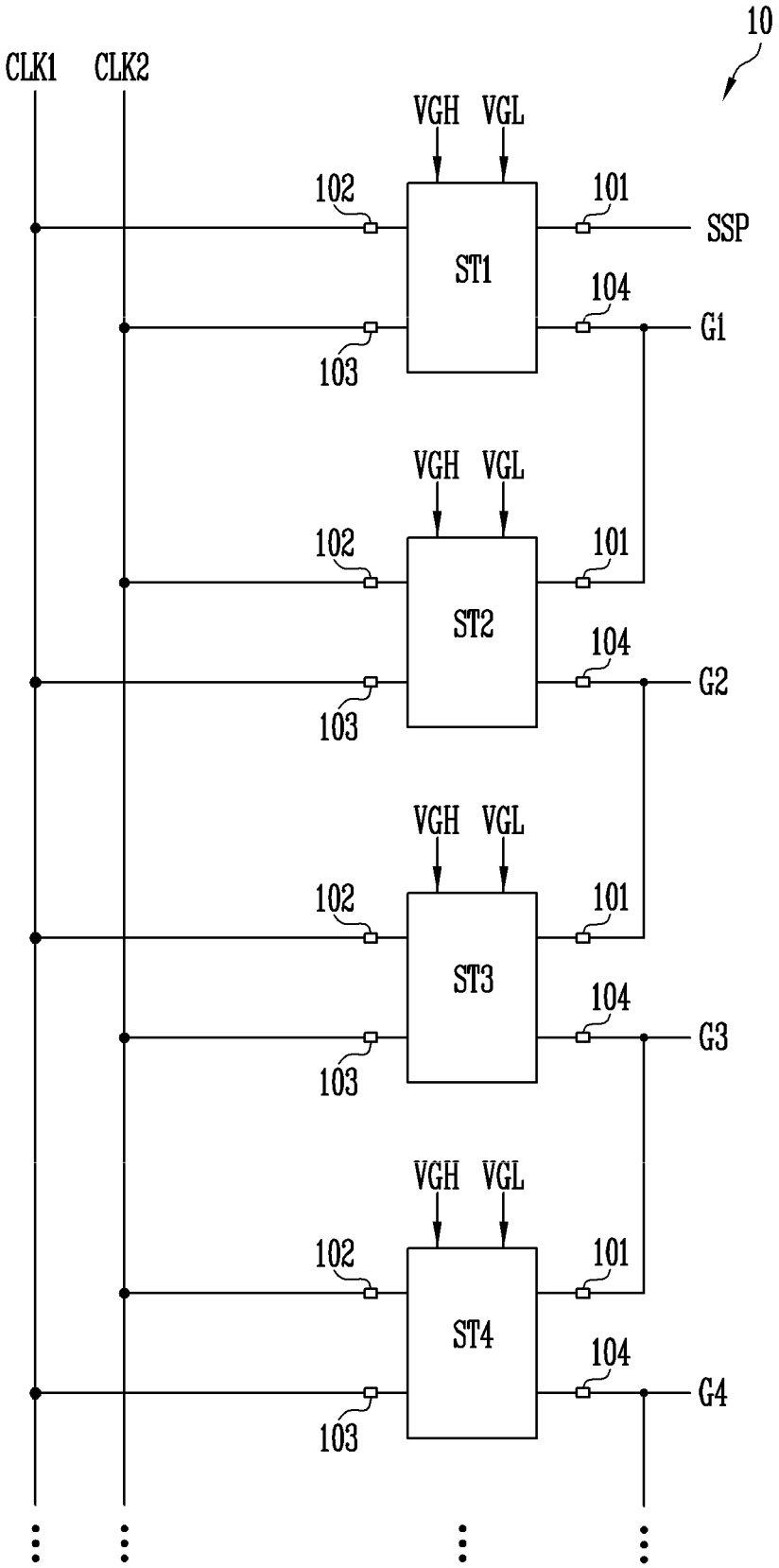
FIG. 4 is a block diagram illustrating a gate driver according to embodiments of the disclosure.

FIG. 4 is a block diagram illustrating a gate driver according to embodiments of the disclosure.

In FIG. 4, for convenience of description, four stages and gate signals output therefrom will be shown.

Referring to FIGS. 1 and 4, the gate driver 10 may include a plurality of stages ST1, ST2, ST3, and ST4. For example, the first, second, third, and fourth stages ST1, ST2, ST3, and ST4 may be connected to predetermined gate lines G1, G2, G3, and G4 respectively, and output gate signals in correspondence with clock signals CLK1 and CLK2. The stages ST1, ST2, ST3, and ST4 may be implemented with substantially the same circuit.

In an embodiment, the gate driver 10 may configure the emission driver 400 and/or the second scan driver 300 described with reference to FIG. 1. For example, gate lines G1, G2, G3, and G4 may be understood as emission control lines (for example, E1, E2, E3, and E4 of FIG. 5A) or second scan lines (for example, S2_1, S2_2, S2_3, and S2_4 of FIG. 5B).

In an embodiment, each of the first, second, third, and fourth stages ST1, ST2, ST3, and ST4 may be connected to at least one gate lines G1, G2, G3, and G4. For example, the first stage ST1 may be connected to the first and second gate lines G1 and G2 to supply a gate signal to the first and second gate lines G1 and G2. However, this is an example, and a connection relationship between the stages ST1, ST2, ST3, and ST4 and the gate lines may be variously changed according to a pixel structure and a driving method of the display device 1000.

Each of the stages ST1, ST2, ST3, and ST4 may include a first input terminal 101, a second input terminal 102, a third input terminal 103, and an output terminal 104.

The first input terminal 101 may receive an output signal (for example, the emission control signal or the second scan signal) of a previous stage or a start pulse SSP (for example, an emission control start pulse or a second scan start pulse). For example, the first input terminal 101 of the first stage ST1 may receive the start pulse SSP, and the first input terminal 101 of the second stage ST2 may receive a gate signal output from the first stage ST1.

In an embodiment, the second input terminal 102 of a k (where k is a natural number) stage may receive the first clock signal CLK1 and the third input terminal 103 may receive the second clock signal CLK2. On the other hand, the second input terminal 102 of a (k+1)-th stage may receive the second clock signal CLK2 and the third input terminal 103 may receive the first clock signal CLK1.

The first clock signal CLK1 and the second clock signal CLK2 have the same period, and phases of the first clock signal CLK1 and the second clock signal CLK2 do not overlap each other. For example, the second clock signal CLK2 may be set as a signal shifted by about half period from the first clock signal CLK1.

In addition, the stages ST1, ST2, ST3, and ST4 receive a voltage of first power VGL and a voltage of second power VGH. The voltage of the first power VGL and the voltage of the second power VGH may have a DC voltage level. The voltage of the second power VGH may be set to be greater than the voltage of the first power VGL.

The voltage of the first power VGL may be set to a gate off level, and the voltage of the second power VGH may be set to a gate on level. For example, when the pixel PX is configured of N-channel metal oxide semiconductor (NMOS) transistors, the voltage (that is, the gate off level) of the first power VGL may correspond to a logic low level, and the voltage (that is, the gate-on level) of the second power VGH may correspond to a logic high level. However, this is an example, and the first power VGL and the second power VGH are not limited. For example, the voltage of the first power VGL and the voltage of the second power VGH may be set according to a type of a transistor, a use environment of the display device, and the like.

Figure 5A:
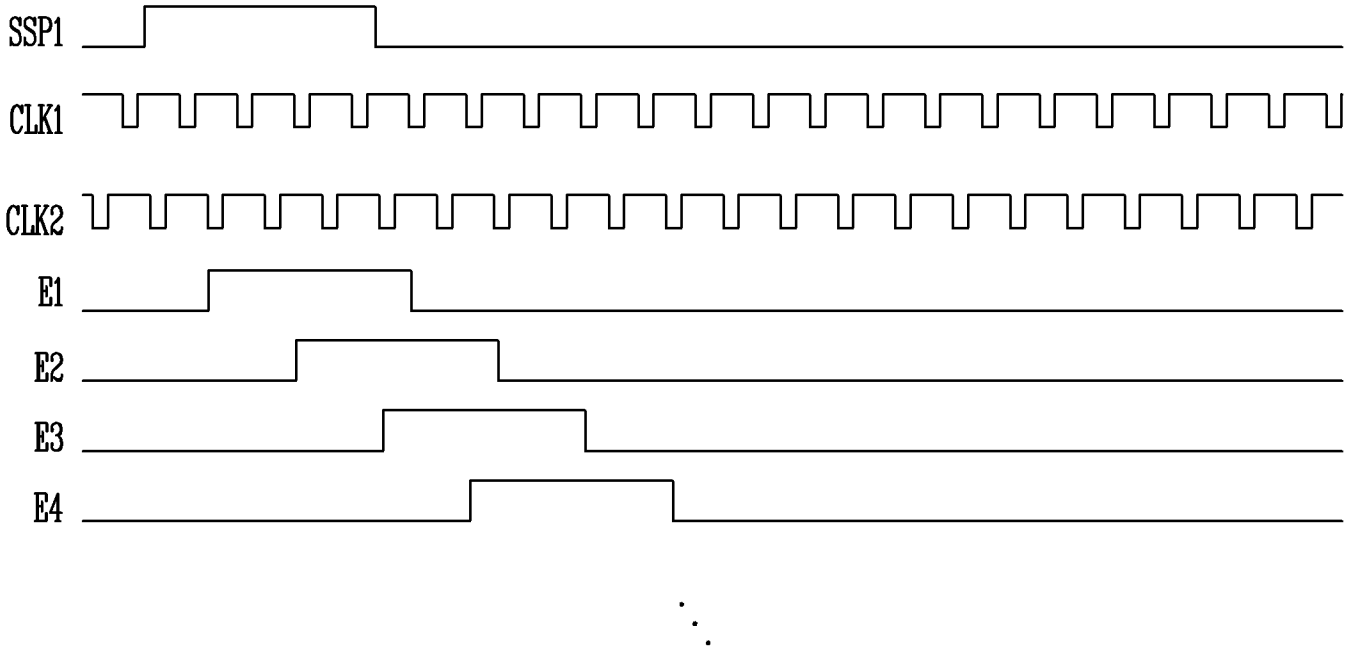
FIG. 5A is a timing diagram illustrating an example of an emission control signal output from an emission driver included in the display device of FIG. 1.

FIG. 5A is a timing diagram illustrating an example of the emission control signal output from the emission driver included in the display device of FIG. 1.

Referring to FIGS. 1, 4, and 5A, the gate driver 10 may be implemented as the emission driver 400. The first, second, third, and fourth stages ST1, ST2, St3, and ST4 may sequentially output the emission control signals respectively.

In an embodiment, within one frame period, an emission control start pulse SSP1 may include a plurality of gate on periods and a plurality of gate off periods of the first and second clock signals CLK1 and CLK2. The first stage ST1 may output the emission control signal to a first emission control line E1 based on the emission control start pulse SSP1 and the first and second clock signals CLK1 and CLK2.

The second stage ST2 may output an emission control signal in which the emission control signal output to the first emission control line E1 is shifted by a predetermined horizontal period, to a second emission control line E2. Similarly, the third and fourth stages ST3 and ST4 may sequentially output the emission control signals at predetermined intervals based on the first and second clock signals CLK1 and CLK2, respectively.

Figure 5B:
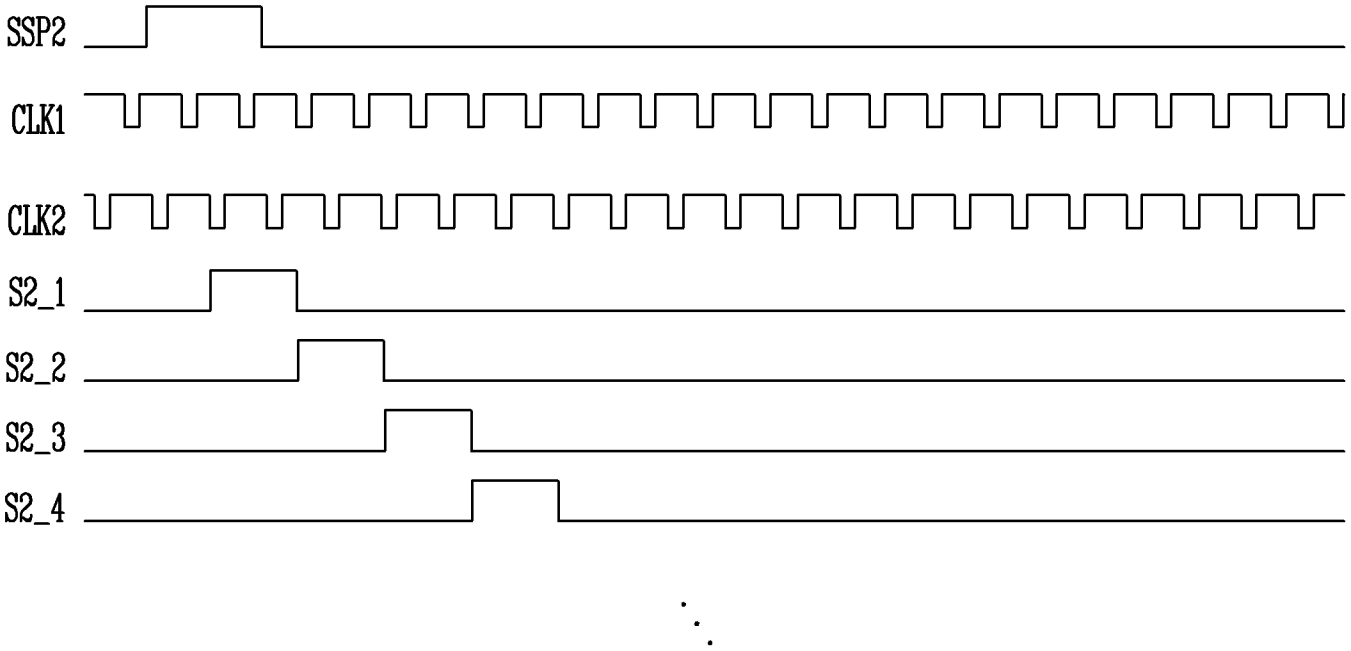
FIG. 5B is a timing diagram illustrating an example of a scan signal output from a scan driver included in the display device of FIG. 1.

FIG. 5B is a timing diagram illustrating an example of the scan signal output from the scan driver included in the display device of FIG. 1.

Referring to FIGS. 1, 3, 4, and 5B, the gate driver 10 may be implemented as the second scan driver 300. The first, second, third, and fourth stages ST1, ST2, ST3 and ST4 may sequentially output the second scan signals respectively.

In an embodiment, within one frame period, a second scan start pulse SSP2 may include a plurality of gate on periods and a plurality of gate off periods of the first and second clock signals CLK1 and CLK2. The first stage ST1 may output the second scan signal to the first second scan line S2_1 based on the second scan start pulse SSP2 and the first and second clock signals CLK1 and CLK2.

The second stage ST2 may output a second scan signal in which the second scan signal output to the first second scan line S2_1 is shifted by a predetermined horizontal period, to the second second scan line S2_2. Similarly, the third and fourth stages ST3 and ST4 may sequentially output the second scan signal at predetermined intervals based on the first and second clock signals CLK1 and CLK2, respectively.

Figure 6:
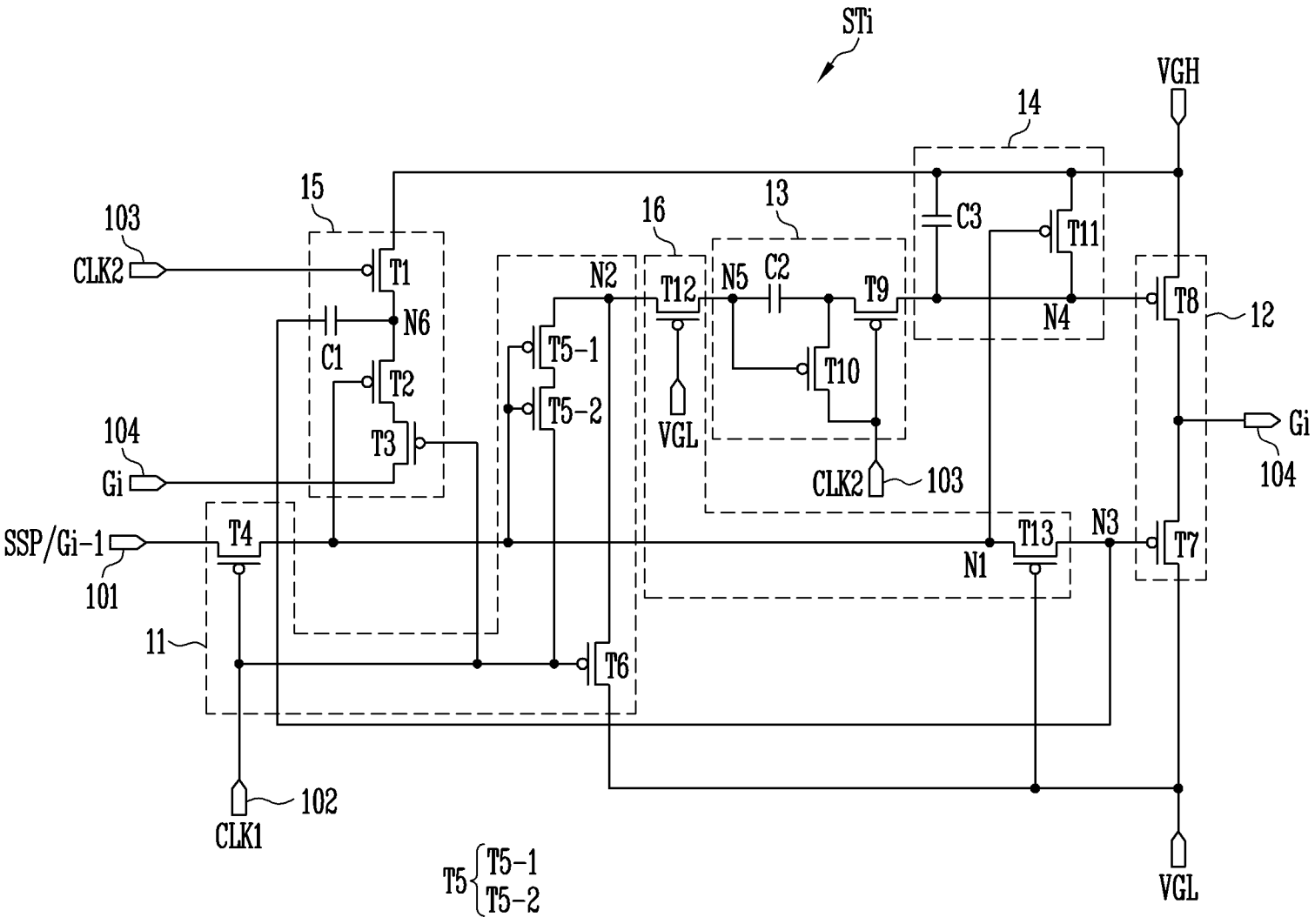
FIG. 6 is a circuit diagram illustrating an example of a stage included in the gate driver of FIG. 4.

FIG. 6 is a circuit diagram illustrating an example of the stage included in the gate driver of FIG. 4.

Referring to FIGS. 4 and 6, the i-th stage STi (where i is a natural number) may include an input circuit 11, an output circuit 12, a first signal processor 13, a second signal processor 14, and a third signal processor 15. The i-th stage STi may further include a stabilizer 16.

The description is given with reference to FIG. 6, based on the i-th stage ST (for example, an odd-numbered stage) to which the first clock signal CLK1 is supplied to the second input terminal 102 and the second clock signal CLK2 is supplied to the third input terminal 103. However, this is an example, and in an (i+1)-th stage (for example, an even-numbered stage), the second clock signal CLK2 may be supplied to the second input terminal 102 and the first clock signal CLK1 may be supplied to the third input terminal 103.

In an embodiment, the start pulse SSP may be supplied to the first input terminal 101 of the first stage ST1, and the gate signal of the previous gate line may be supplied to the first input terminal 101 of the remaining stages.

The input circuit 11 may control voltages of the first node N1 and the second node N2 in response to signals supplied to the first input terminal 101 and the second input terminal 102. In an embodiment, the input circuit 11 may include fourth, fifth, and sixth transistors T4, T5, and T6.

The fourth transistor T4 may be connected between the first input terminal 101 and the first node N1. The fourth transistor T4 may include a gate electrode connected to the second input terminal 102. The fourth transistor T4 may be turned on when the first clock signal CLK1 has a gate on level, to electrically connect the first input terminal 101 and the first node N1 to each other.

The fifth transistor T5 may be connected between the second input terminal 102 and the second node N2. The fifth transistor T5 may include a gate electrode connected to the first node N1. The fifth transistor T5 may be turned on or turned off based on the voltage of the first node N1.

In an embodiment, the fifth transistor T5 may include sub transistors T5-1 and T5-2 connected in series with each other. Each of the sub transistors T5-1 and T5-2 may include a gate electrode commonly connected to the first node N1. Therefore, a current leakage by the fifth transistor T5 may be minimized.

The sixth transistor T6 may be connected between the first power VGL and the second node N2. A gate electrode of the sixth transistor T6 may be connected to the second input terminal 102. The sixth transistor T6 may be turned on when the first clock signal CLK1 is supplied to the second input terminal 102, to supply the voltage of the first power VGL to the second node N2.

The output circuit 12 may supply the voltage of the first power VGL or the voltage of the second power VGH to the output terminal 104 in response to the voltage of the third node N3 and the voltage of the fourth node N4. The voltage of the first power VGL may correspond to the logic low level of the gate signal (hereinafter, referred to as a gate signal) supplied to the i-th gate line Gi, and the voltage of the second power VGH may correspond to the logic high level of the gate signal. The gate signal may be determined as the emission control signal or the scan signal in the display device.

In an embodiment, the output circuit 12 may include a seventh transistor T7 and an eighth transistor T8.

The seventh transistor T7 may be connected between the first power VGL and the output terminal 104. A gate electrode of the seventh transistor T7 may be connected to the third node N3. The seventh transistor T7 may be turned on or turned off in response to the voltage of the third node N3. Here, when the seventh transistor T7 is turned on, the gate signal supplied to the output terminal 104 may have a logic low level (for example, a gate-off voltage of the N-type transistor).

The eighth transistor T8 may be connected between the second power VGH and the output terminal 104. A gate electrode of the eighth transistor T8 may be connected to the fourth node N4. The eighth transistor T8 may be turned on or turned off in response to the voltage of the fourth node N4. Here, the gate signal supplied to the output terminal 104 when the eighth transistor T8 is turned on may have a logic high level (for example, a gate-on voltage of the N-type transistor).

The first signal processor 13 may include a fifth node N5 that electrically connects the second node N2 and the fourth node N4 to each other. The first signal processor 13 may control the voltage of the fourth node N4 based on the second clock signal CLK2 supplied to the third input terminal 103 and a voltage of the fifth node N5. For example, when the voltage of the second node N2 has a logic high level, the first signal processor 13 may cause the eighth transistor T8 to be completely turned off by causing the voltage of the fourth node N4 to stably have a gate off level.

In an embodiment, the first signal processor 13 may include a ninth transistor T9, a tenth transistor T10, and a second capacitor C2.

A first terminal of the second capacitor C2 may be connected to the fifth node N5.

The ninth transistor T9 may be connected between a second terminal of the second capacitor C2 and the fourth node. A gate electrode of the ninth transistor T9 may be connected to the third input terminal 103. The ninth transistor T9 may be turned on in response to a gate on level (for example, a logic low level) of the second clock signal CLK2 supplied to the third input terminal 103.

The tenth transistor T10 may be connected between a second terminal of the second capacitor C2 and the third input terminal 103. A gate electrode of the tenth transistor T10 may be connected to the fifth node N5. The tenth transistor T10 may be turned on or turned off in response to the voltage of the fifth node N5.

The second signal processor 14 may control the voltage of the fourth node N4 in response to the voltage of the first node N1. For example, when the first node N1 has a logic low level, the second signal processor 14 may cause the eighth transistor T8 of the output circuit 12 to be completely turned off by causing the voltage of the fourth node N4 to stably have a logic high level. In an embodiment, the second signal processor 14 may include an eleventh transistor T11 and a third capacitor C3.

The eleventh transistor T11 may be connected between the second power VGH and the fourth node N4. A gate electrode of the eleventh transistor T11 may be connected to the first node N1. The eleventh transistor T11 may be turned on or turned off in response to the voltage of the first node N1.

The third capacitor C3 may be connected between the second power VGH and the fourth node N4. The third capacitor C3 may charge the voltage applied to the fourth node N4, and stably maintain the voltage of the fourth node N4.

For example, when the seventh transistor T7 is turned on by the voltage of the first node N1 and/or the voltage of the third node N3, the eleventh transistor T11 may be turned on, and thus the voltage of the second power VGH may be supplied to the fourth node N4.

The stabilizer 16 may be electrically connected between the input circuit 11 and the output circuit 12. The stabilizer 16 may limit a voltage drop of the first node N1 and a voltage drop of the second node N2.

In an embodiment, as the stabilizer 16 acts as a resistor when the voltage of the fifth node N5 rapidly drops to a second low level (refer to 2L of FIG. 7), voltage distribution occurs, and the stabilizer 16 may prevent a rapid change of drain-source voltages of the fifth transistor T5 and the sixth transistor T6. Therefore, the fifth transistor T5 and the sixth transistor T6 may be protected.

In addition, the stabilizer 16 may protect the fourth transistor T4 by acting as a resistance when the voltage of the third node N3 rapidly drops to the second low level.

In an embodiment, the stabilizer 16 may include a twelfth transistor T12 and a thirteenth transistor T13.

A gate electrode of the thirteenth transistor T13 may be connected to the first power VGL. Therefore, the thirteenth transistor T13 may always have a turn-on state. When the voltage of the third node N3 rapidly drops to the second low level, voltage distribution occurs by the thirteenth transistor T13, and a rapid change of drain-source voltages of the fourth transistor T4 may be prevented.

The twelfth transistor T12 may be connected between the second node N2 and the fifth node N5. A gate electrode of the twelfth transistor T12 may be connected to the first power VGL. Therefore, the twelfth transistor T12 may always have a turn-on state. The twelfth transistor T12 may prevent a rapid change of drain-source voltages of the fifth transistor T5 and the sixth transistor T6 according to a rapid voltage change of the fifth node N5 or the fourth node N4.

The third signal processor 15 may control the voltage of the third node N3 electrically connected to the first node N1, in response to signals (for example, the first clock signal CLK1 and the second clock signal CLK2) supplied to the second input terminal 102 and the third input terminal 103 and the voltage of the first node N1. The third signal processor 15 may control a voltage change of the third node N3 based on the voltage of the second power VGH or the voltage of the gate signal.

In an embodiment, the third signal processor 15 may include first, second, and third transistors T1, T2, and T3 and a first capacitor C1.

The first transistor T1 may be connected between the second power VGH and the sixth node N6. A gate electrode of the first transistor T1 may be connected to the third input terminal 103. The first transistor T1 may be turned on in response to a gate on level of the second clock signal CLK2. When the first transistor T1 is turned on, the voltage of the second power VGH may be supplied to the sixth node N6.

The second transistor T2 and the third transistor T3 may be connected in series, and connected to the sixth node N6 and the output terminal 104 respectively. A gate electrode of the second transistor T2 may be connected to the first node N1, and a gate electrode of the third transistor T3 may be connected to the second input terminal 102.

The second transistor T2 may be turned on or turned off in response to the voltage of the first node N1. The third transistor T3 may be turned on in response to a gate on level of the first clock signal CLK1. When the second and third transistors T2 and T3 are turned on simultaneously, a voltage of the gate signal may be supplied to the sixth node N6. The voltage of the sixth node N6 may be determined in correspondence with the voltage of the second power VGH (that is, the logic high level) or a voltage of the output terminal 104.

The first capacitor C1 may be connected between the sixth node N6 and the third node N3. The third signal processor 15 may control the voltage of the third node N3 by using coupling of the first capacitor C1 according to a voltage change of the sixth node N6. For example, when the voltage of the sixth node N6 having the logic high level drops to the logic low level of the gate signal by the turn-on of the second and third transistors T2 and T3, the voltage of the third node N3 may rapidly drop to the second low level due to the coupling of the first capacitor C1. Therefore, the seventh transistor T7 is completely turned on. Thus, a falling speed of the gate signal may be increased, a falling time may be minimized, and a falling step of a gate signal output may be removed or reduced.

Figure 7:
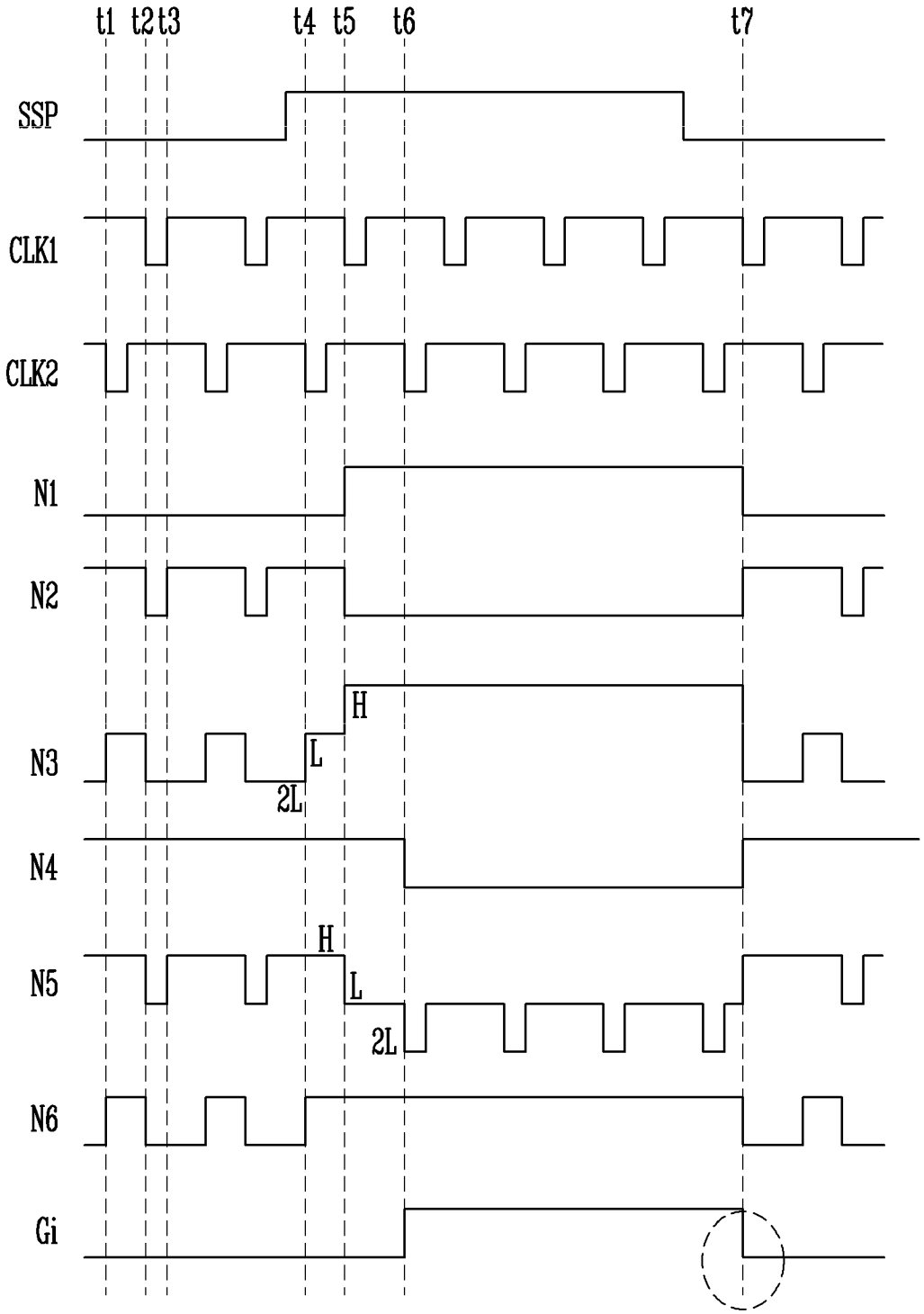
FIG. 7 is a timing diagram illustrating an example of an operation of the stage of FIG. 6.

FIG. 7 is a timing diagram illustrating an example of an operation of the stage of FIG. 6.

Referring to FIGS. 6 and 7, the first clock signal CLK1 and the second clock signal CLK2 are supplied at different timings. For example, the second clock signal CLK2 is set as a signal shifted by a half period (for example, one horizontal period 1H) from the first clock signal CLK1.

A logic high level (or a high voltage) of the start pulse SSP may correspond to the voltage of the second power VGH, and a logic low level or a low voltage of the start pulse SSP may correspond to the voltage of the first power VGL. However, this is an example, and a voltage level of the start pulse is not limited.

In an embodiment, the start pulse SSP may have a waveform for an output of the emission control signal according to FIG. 5A or a waveform for an output of the scan signal (for example, the second scan signal) according to FIG. 5B. That is, the start pulse SSP and the gate signal during one frame period may include a plurality of gate on periods and gate off periods of the clock signals CLK1 and CLK2.

Hereinafter, description will be given based on an embodiment in which the voltage of the first power VGL is supplied to each of the second input terminal 102 and the third input terminal 103 when the clock signals CLK1 and CLK2 are supplied, and the voltage of the second power VGH is supplied to the second input terminal 102 and the third input terminal 103 when the clock signals CLK1 and CLK2 are not supplied.

The start pulse SSP has the logic low level at a first time point t1, a second time point t2, a third time point t3, and a seventh time point t7. The start pulse SSP has the logic high level at a fourth time point t4, a fifth time point t5, and a sixth time point t6.

The second clock signal CLK2 may be supplied to the third input terminal 103 at the first time point t1. The first transistor T1 may be turned on in response to the second clock signal CLK2 at the first time point t1. When the first transistor T1 is turned on, the voltage of the second power VGH may be supplied to the sixth node N6 (that is, one terminal of the first capacitor C1). Therefore, the voltage of the third node N3 may rise to a first low level L1. The voltages of the first node, the second node N2, the fourth node N4, and the fifth node N5 may maintain the levels of a previous state. Changed voltages of the third node N3 and the sixth node N6 may be substantially maintained until the second time point t2.

The first clock signal CLK1 may be supplied to the second input terminal 102 at the second time point t2. The third transistor T3, the fourth transistor T4, and the sixth transistor T6 may be turned on in response to the first clock signal CLK1 at the second time point t2. Therefore, when the fourth transistor T4 is turned on, the logic low level of the start pulse SSP may be supplied to the first node N1, and when the sixth transistor T6 is turned on, the voltage of the first power VGL may be supplied to second node N2.

The voltage of the second node N2 may be transferred to the fifth node N5 by the twelfth transistor T12.

In addition, the second transistor T2 and the eleventh transistor T11 may be turned on at the second time point t2 by the voltage of the first node N1. When the second and third transistors T2 and T3 are turned on together, a logic low level of the gate signal of the output terminal 104 may be supplied to the sixth node N6. Since the voltages of the first node N1 and the sixth node N6 have a logic low level, the voltage of the third node N3 may drop to the second low level 2L.

When the eleventh transistor T11 is turned on, the voltage of the second power VGH may be supplied to the fourth node N4. Therefore, the fourth node N4 may maintain a voltage of a logic high level. A voltage corresponding to the second power VGH may be charged in the third capacitor C3.

The supply of the first clock signal CLK1 may be stopped at the third time point t3. Both of the first and second clock signals CLK1 and CLK2 may have a logic high level. Therefore, the fourth and sixth transistors T4 and T6 may be turned off. At this time, the first node N1, the third node N3, and the fourth node N4 may maintain the voltage of the previous period by the first capacitor C1 and the third capacitor C3.

When the fifth transistor T5 is turned on by the voltage of the first node N1 of a logic low level at the third time point t3, a logic high level from the second input terminal 102 may be supplied to the second node N2 and the fifth node N5. Then, the tenth transistor T10 may be turned off.

When a logic low level state of the start pulse SSP is maintained, an operation of the first, second, and third time points t1, t2, and t3 may be repeated. At this time, the voltage of the fourth node N4 may be maintained as a logic high level, and thus the eighth transistor T8 may be set to a turn-off state. In addition, the voltage of the third node N3 may repeat a state of the first low level L1 and a state of the second low level 2L. Since the seventh transistor T7 is turned on by the first low level L1 and the second low level 2L, the gate signal may be output as a logic low level corresponding to the first power VGL.

Meanwhile, a logic low level is supplied to the sixth node N6 whenever the first clock signal CLK1 is supplied during a period in which the gate signal is output as the logic low level. Therefore, the logic low level is periodically supplied to the third node N3 and the first node N1 and thus refresh is performed. Thus, the seventh transistor T7 may maintain a stable turn-on state. Therefore, the logic low level of the gate signal may be stably output.

Thereafter, the start pulse SSP is transited to the logic high level.

The second clock signal CLK2 may be supplied to the third input terminal 103 at the fourth time point t4. The first transistor T1 may be turned on in response to the second clock signal CLK2. When the first transistor T1 is turned on, the voltage of the second power VGH may be supplied to the sixth node N6. Therefore, the voltage of the third node N3 may rise to the first low level L.

The first clock signal CLK1 may be supplied to the second input terminal 102 at the fifth time point t5. The third transistor T3, the fourth transistor T4, and the sixth transistor T6 may be turned on in response to the first clock signal CLK1. When the fourth transistor T4 is turned on, the logic high level of the start pulse SSP may be supplied to the first node N1. When the sixth transistor T6 is turned on, the voltage of the first power VGL may be supplied to the second node N2, and the fifth node N5 may have a voltage of the first low level L.

At this time, the voltage of the third node N3 may rise to the high level H by the coupling of the first capacitor C1 according to a voltage increase of the first node N1. Therefore, the seventh transistor T7 may be turned off by the voltage of the third node N3 of the high level H.

In addition, the tenth transistor T10 may be turned on by the voltage of the fifth node N5 at the fifth time point t5, and the logic high level of the second clock signal CLK2 may be supplied to the second terminal of the second capacitor C2.

At this time, since the ninth transistor T9 is turned off, the voltage of the fourth node N4 may maintain the voltage of the second power VGH regardless of the second terminal voltage of the second capacitor C2.

The second clock signal CLK2 may be supplied to the third input terminal 103 at the sixth time point t6. The first transistor T1 may be turned on in response to the second clock signal CLK2. When the first transistor T1 is turned on, the voltage of the second power VGH may be supplied to the sixth node N6. Therefore, the voltage of the third node N3 may maintain the high level H. The seventh transistor T7 may maintain a turn-off state by the voltage of the high level H of the third node N3.

In addition, the first node N1 and the second node N2 may maintain a voltage of a previous period.

In addition, the ninth transistor T9 may be turned on in response to the second clock signal CLK2. Since a voltage of the second terminal of the second capacitor C2 drops by the second clock signal CLK2 at the fifth time point t5, the voltage of the fifth node N5 may drop to the second low level 2L due to coupling of the second capacitor C2. Therefore, the voltage of the fourth node N4 drops, and the eighth transistor T8 may be turned on by the voltage of the fourth node N4.

When the eighth transistor T8 is turned on, the voltage of the second power VGH may be supplied to the output terminal 104. Therefore, the gate signal may be output as the logic high level.

Thereafter, an I-th stage STi may output the gate signal of the logic high level during a period in which the start pulse SSP is supplied as the logic high level.

At the seventh time point t7, the start pulse SSP may have the logic low level again and the first clock signal CLK1 may be supplied. The third transistor T3, the fourth transistor T4, and the sixth transistor T6 may be turned on in response to the first clock signal CLK1. When the fourth transistor T4 is turned on, the logic low level of the start pulse SSP may be supplied to the first node N1, and when the sixth transistor T6 is turned on, the voltage of the first power VGL may be supplied to the second node N2.

The voltage of the second node N2 may be transferred to the fifth node N5 by the twelfth transistor T12.

In addition, the eleventh transistor T11 may be turned on by the voltage of the first node N1 at the seventh time point t7. When the eleventh transistor T11 is turned on, the voltage of the second power VGH may be supplied to the fourth node N4, and the eighth transistor T8 may be turned off.

In addition, the second transistor T2 may be turned on by the voltage of the first node N1 at the seventh time point t7. When the second and third transistors T2 and T3 are turned on together, the logic low level of the gate signal of the output terminal 104 may be supplied to the sixth node N6. Since the voltages of the first node N1 and the sixth node N6 are changed to a logic low level, the voltage of the third node N3 may be very rapidly drop from the high level H to the second low level 2L by the coupling of the first capacitor C1.

Therefore, an absolute value of a gate-source voltage of the seventh transistor T7 may become very large. Therefore, the falling speed of the gate signal output from the output terminal 104 becomes very high, and the step of falling of the gate signal may be removed. For example, the gate signal (that is, the gate signal or the emission control signal supplied to the i-th gate line Gi) may be transited to the low level in synchronization with a voltage drop of the third node N3 and a voltage drop of the sixth node N6.

As described above, the gate driver (or the emission driver 400 of FIG. 1) and the display device including the same according to embodiments of the disclosure include the third signal processor 15 in the stage ST. Therefore, the falling speed of the gate signal may increase and the falling step may be substantially removed. Therefore, driving reliability and image quality in a high speed driving method of the display device may be improved.

Figure 8:
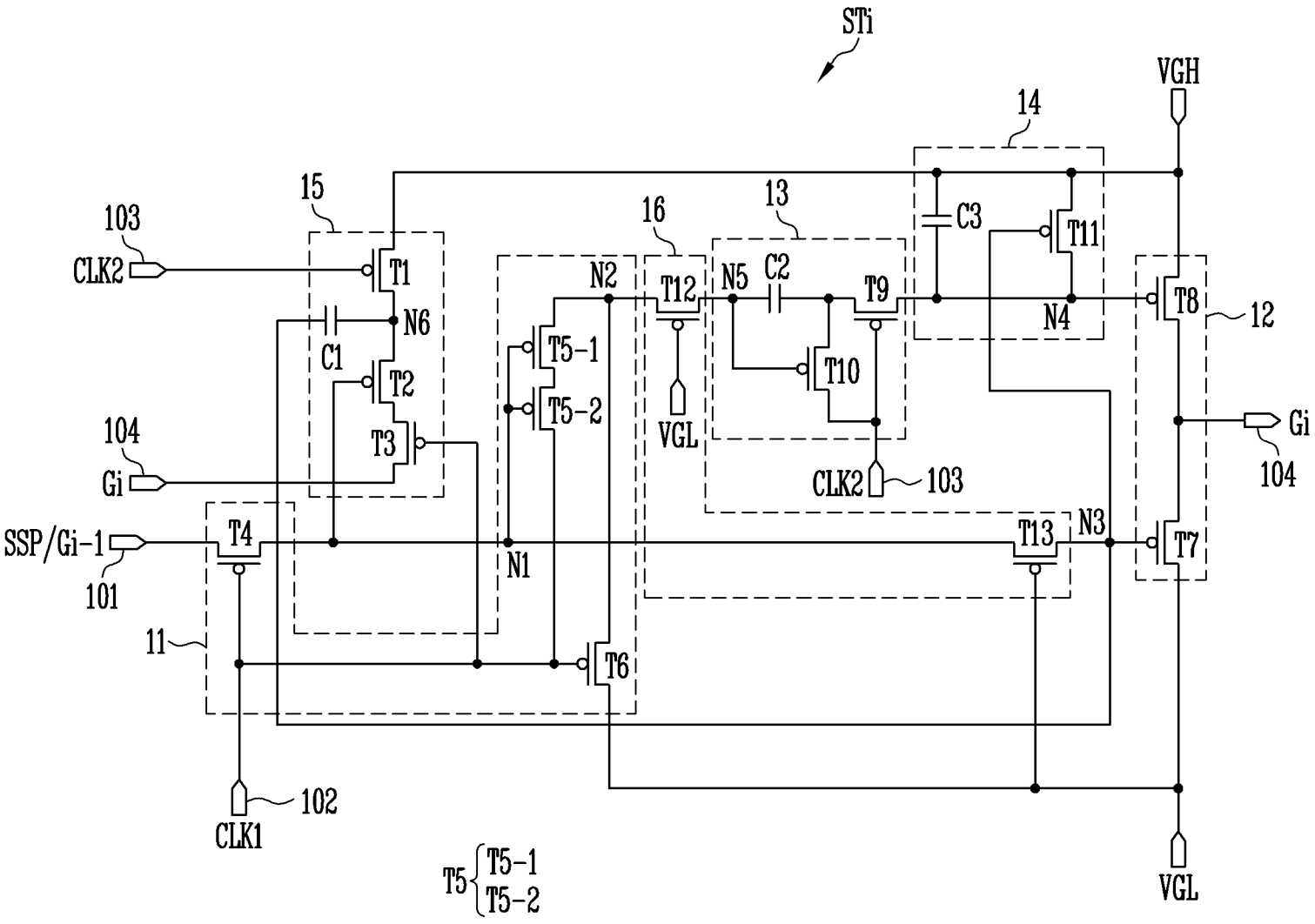
FIG. 8 is a circuit diagram illustrating another example of the stage included in the gate driver of FIG. 4.

FIG. 8 is a circuit diagram illustrating another example of the stage included in the gate driver of FIG. 4.

In FIG. 8, the same reference numerals are used for the components described with reference to FIG. 6, and repetitive description of such components will be omitted. In addition, the stage of FIG. 8 may have a configuration substantially equal to or similar to that of the stage of FIG. 6 except for a configuration of the eleventh transistor.

Referring to FIG. 8, the second signal processor 14 may supply the voltage of the second power VGH to the fourth node N4 in response to the voltage of the third node N3. The second signal processor 14 may include a third capacitor C3 and an eleventh transistor T11.

In an embodiment, a gate electrode of the eleventh transistor T11 may be connected to the third node N3. Therefore, the eleventh transistor T11 may operate in response to the voltage of the third node N3.

Figure 9:
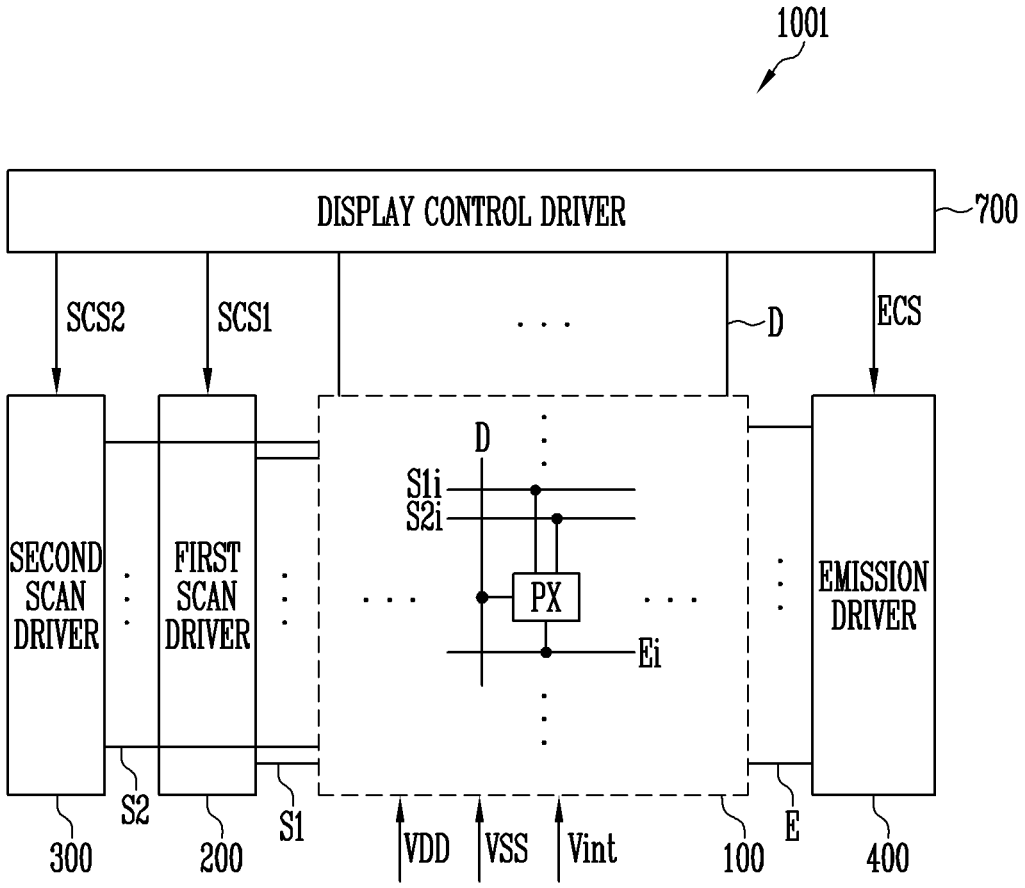
FIG. 9 is a block diagram illustrating a display device according to embodiments of the disclosure.

FIG. 9 is a block diagram illustrating a display device according to embodiments of the disclosure.

In FIG. 9, the same reference numerals are used for the components described with reference to FIG. 1, and repetitive description of such components will be omitted. In addition, the display device 1001 of FIG. 9 may have a configuration substantially equal to or similar to that of the display device 1000 of FIG. 1 except for a configuration of a display control driver 700.

Referring to FIG. 9, the display device 1001 may include the display unit 100, the first scan driver 200 (or first gate driver), the second scan driver 300 (or second gate driver), the emission driver 400 (or third gate driver), and the display control driver 700.

The display control driver 700 may receive an input control signal and an input image signal from an image source such as an external graphic device. The display control driver 700 may generate the first driving control signal SCS1, the second driving control signal SCS2, and the third driving control signal ECS based on an input control signal, and provide the first driving control signal SCS1, the second driving control signal SCS2, and the third driving control signal ECS to the first scan driver 200, the second scan driver 300, and the emission driver 400 respectively. In addition, the display control driver 700 may supply the data signal (data voltage) of an analog format to the data lines D based on the input control signal and the input image signal.

In other words, the display control driver 700 may include a function of the timing controller 600 and the data driver 500 of FIG. 1. In an embodiment, the display control driver 700 may be mounted on a panel of the display device 1001 in one driving chip (for example, a timing controller embedded driver (TED) IC) type including the function of the timing controller 600 and the data driver 500. Therefore, a dead space of the display device 1001 may be reduced.

However, this is an example, and the configuration of the display control driver 700 is not limited. For example, the display control driver 700 may further include a configuration or a function of at least a portion of the first scan driver 200, the second scan driver 300, and the emission driver 400. In addition, the display control driver 700 may supply at least one of the voltages of the first driving power VDD, the second driving power VSS, and the initialization power Vint to the display unit 100.

As described above, the emission driver (or gate driver) and the display device including the same according to the embodiments of the disclosure include the third signal processor in the stage, thereby increasing a falling speed of the emission control signal (or gate signal) and substantially removing a falling step. Therefore, driving reliability and image quality in a high speed driving method of the display device may be improved.

In addition, a logic low level of the emission control signal may be stably output by periodically supplying the logic low level to the first and third nodes for refreshing during a period in which the emission control signal is output at the logic low level.

However, the effect of the disclosure is not limited to the above-described effect, and may be variously expanded within a range not departing from the spirit and scope of the disclosure.

Although the disclosure has been described with reference to the embodiments, it will be understood by those skilled in the art that various changes and modifications of the disclosure may be made without departing from the spirit and scope of the disclosure disclosed in the following claims.

What is claimed is:

1. An emission driver comprising:

a plurality of stages configured to output an emission control signal, wherein at least one of the stages comprises:

an input circuit configured to control voltages of a first node and a second node in response to signals supplied to a first input terminal and a second input terminal;

an output circuit configured to supply a voltage of a first power or a voltage of a second power to an output terminal as the emission control signal in response to a voltage of a third node and a voltage of a fourth node;

a first signal processor connected to a fifth node electrically connecting the second node and the fourth node together and configured to control the voltage of the fourth node based on a signal supplied to a third input terminal and a voltage of the fifth node;

a second signal processor configured to control the voltage of the fourth node based on the voltage of the first node; and a third signal processor configured to control the voltage of the third node electrically connected to the first node in response to the signals supplied to the second input terminal and the third input terminal, and the voltage of the first node.

2. The emission driver of claim 1, wherein the third signal processor controls a voltage change of the third node based on the voltage of the second power or a voltage of the emission control signal.

3. The emission driver of claim 1, wherein the third signal processor comprises:

a first transistor connected between the second power and a sixth node, and having a gate electrode connected to the third input terminal;

a second transistor and a third transistor connected to the second transistor in series, and connected to the sixth node and the output terminal respectively; and a first capacitor connected between the sixth node and the third node, wherein a gate electrode of the second transistor is connected to the first node, and wherein a gate electrode of the third transistor is connected to the second input terminal.

4. The emission driver of claim 3, wherein a voltage of the sixth node is determined in correspondence with the voltage of the second power or a voltage of the output terminal.

5. The emission driver of claim 4, wherein the third signal processor controls the voltage of the third node by using coupling of the first capacitor according to a voltage change of the sixth node.

6. The emission driver of claim 3, wherein the emission control signal is transited to a low level in synchronization with a voltage drop of the third node and a voltage drop of the sixth node.

7. The emission driver of claim 1, wherein the input circuit comprises:

a fourth transistor connected between the first input terminal and the first node, and having a gate electrode connected to the second input terminal;

a fifth transistor connected between the second input terminal and the second node, and having a gate electrode connected to the first node; and a sixth transistor connected between the first power and the second node, and having a gate electrode connected to the second input terminal.

8. The emission driver of claim 7, wherein the fifth transistor comprises at least two sub transistors connected in series with each other, and each of the sub transistors includes a gate electrode commonly connected to the first node.

9. The emission driver of claim 1, wherein the output circuit comprises:

a seventh transistor connected between the first power and the output terminal, and having a gate electrode connected to the third node; and an eighth transistor connected between the second power and the output terminal, and having a gate electrode connected to the fourth node.

10. The emission driver of claim 1, wherein the at least one of the stages further comprises:

a stabilizer electrically connected between the input circuit and the output circuit, and configured to limit a voltage drop of the first node and the second node.

11. The emission driver of claim 10, wherein the stabilizer comprises:

a twelfth transistor connected between the second node and the fifth node, and having a gate electrode connected to the first power and receiving the voltage of the first power; and a thirteenth transistor connected between the first node and the third node, and having a gate electrode connected to the first power and receiving the voltage of the first power.

12. The emission driver of claim 10, wherein the first signal processor comprises:

a second capacitor having a first terminal connected to the fifth node;

a ninth transistor connected between a second terminal of the second capacitor and the fourth node, and having a gate electrode connected to the third input terminal; and a tenth transistor connected between the second terminal of the second capacitor and the third input terminal, and having a gate electrode connected to the fifth node.

13. The emission driver of claim 10, wherein the second signal processor comprises:

an eleventh transistor connected between the second power and the fourth node, and having a gate electrode electrically connected to the first node; and a third capacitor connected between the second power and the fourth node.

14. The emission driver of claim 10, wherein the second signal processor comprises:

an eleventh transistor connected between the second power and the fourth node, and having a gate electrode electrically connected to the third node; and a third capacitor connected between the second power and the fourth node.

15. The emission driver of claim 1, wherein the first input terminal receives an output signal of a previous stage or a start pulse, the second input terminal receives a first clock signal, and the third input terminal receives a second clock signal obtained by shifting the first clock signal.

16. A display device comprising:

a plurality of pixels;

a scan driver configured to supply a scan signal to the pixels through scan lines;

a data driver configured to supply a data signal to the pixels through data lines; and an emission driver including a plurality of stages to supply an emission control signal to the pixels through emission control lines, wherein at least one of the stages comprises:

an input circuit configured to control voltages of a first node and a second node in response to signals supplied to a first input terminal and a second input terminal;

an output circuit configured to supply a voltage of a first power or a voltage of a second power to an output terminal as the emission control signal in response to a voltage of a third node and a voltage of a fourth node;

a first signal processor connected to a fifth node electrically connecting the second node and the fourth node to each other and configured to control the voltage of the fourth node based on a signal supplied to a third input terminal and a voltage of the fifth node;

a second signal processor configured to control the voltage of the fourth node based on the voltage of the third node; and a third signal processor configured to control the voltage of the third node electrically connected to the first node in response to the signals supplied to the second input terminal and the third input terminal and the voltage of the first node.

17. The display device of claim 16, wherein each of the pixels includes an N-type transistor including an oxide semiconductor.

18. The display device of claim 17, wherein the scan driver includes a scan stage that outputs an N-type scan signal for controlling the N-type transistor, and the scan stage has the same configuration as the at least one of the stages.

19. The display device of claim 16, wherein the third signal processor controls a voltage change of the third node based on the voltage of the first power or a voltage of the emission control signal.

20. The display device of claim 19, wherein the third signal processor comprises:

a first transistor connected between the second power and a sixth node, and having a gate electrode connected to the third input terminal;

a second transistor and a third transistor connected to the second transistor in series, and connected to the sixth node and the output terminal respectively; and a first capacitor connected between the sixth node and the third node, wherein a gate electrode of the second transistor is connected to the first node, and wherein a gate electrode of the third transistor is connected to the second input terminal.

* * * * *